United States Patent [19]

Becker et al.

[11] Patent Number: 4,915,331

[45] Date of Patent: Apr. 10, 1990

[54] MANICURE AID

[76] Inventors: Bernard C. Becker; Daniel H. Becker, both of 1720 NE. 80th Ave., Portland, Oreg. 97213; Cherie C. Nadon, 1906 SE. 20th Ave., Portland, Oreg. 97214

[21] Appl. No.: 314,327

[22] Filed: Feb. 22, 1989

Related U.S. Application Data

[63] Continuation of Ser. No. 166,007, Mar. 9, 1988, abandoned.

[51] Int. Cl.[4] ..... F16M 13/00

[52] U.S. Cl. ..... 248/118; 248/349; 132/73

[58] Field of Search ..... 248/118, 118.2–118.5, 248/125, 131; 132/73, 73.5

[56] References Cited

U.S. PATENT DOCUMENTS

| | | | |
|---|---|---|---|
| 2,171,804 | 9/1939 | Perez | 132/73 |
| 4,183,583 | 1/1980 | Zuesse | 248/118 |
| 4,296,766 | 10/1981 | Benis | 132/73 |
| 4,321,935 | 3/1982 | Sussman | 132/73 |
| 4,332,263 | 6/1982 | Kitvall | 248/118 X |
| 4,648,574 | 3/1987 | Granlund | 248/349 |

FOREIGN PATENT DOCUMENTS

| | | | |
|---|---|---|---|
| 78358 | 3/1894 | Fed. Rep. of Germany | 248/118.3 |
| 3151588 | 7/1983 | Fed. Rep. of Germany | 132/73 |
| 2119067 | 11/1983 | United Kingdom | 248/118 |

*Primary Examiner*—Alvin C. Chin-Shue
*Attorney, Agent, or Firm*—Robert L. Harrington

[57] ABSTRACT

A manicure aid that includes base that grips the table top and resists sliding. A wrist support is adjustably supported above the base. A palm supporting pedestal forward of the wrist support maintains the hand elevated and in repose for convenient manicure treatment. An adapter removably mounted to the pedestal positions the fingers for nail polishing.

4 Claims, 2 Drawing Sheets

MANICURE AID

FIELD OF INVENTION

This invention relates to a device for aiding a manicurist and more particularly to a device for supporting the customer's hands in a manner that makes the fingers comfortably accessible for manicure treatment.

BACKGROUND OF THE INVENTION

Manicuring a customer's fingers involves the shaping, trimming, etc. of the fingernails. For long periods of time, a customer holds his or her hands generally on a table top with the fingers extended. The fingers are individually worked on and the manicurist grips and holds each finger somewhat tightly as the fingernails and cuticles are carefully shaped.

The position of the hand while this treatment is occurring is not a natural position and the muscles of the hand become fatigued. So too does that of the manicurist as she or he is holding the finger and has to maintain the desired position while the customer shifts, turns and pulls her hand seeking different hand positions to relieve the fatigued muscles.

The discomfort to the customer is somewhat short lived while that of the manicurist is an all-day long affair.

The only known aid for the manicurist is the use of a small towel that is rolled and placed under the customer's wrists. This support for the customer's hand helps but is far short of removing the problem.

BRIEF DESCRIPTION OF THE INVENTION

The preferred embodiment of the present invention has a base on top of which is provided a wrist support and a hand or palm support. The palm support is a pedestal that suggests the shape of the top couple of inches of a broom handle. The wrist support is a cylindrical crossbar that is supported on posts that enable the bar to be elevated or lowered relative to the base. The customer hooks her wrist over the bar while nesting the palm of her hand on the pedestal. The fingers are generally reposed for convenient handling by the manicurist. The base has a bottom section with a bottom gripping surface of rubber or the like that grips the table top surface and prevents sliding thereof relative to the table. Thus, the tendency of the customer pulling her hand is resisted by the crossbar, the crossbar being held in place by the gripping surface. The base also has an upper section that carries the pedestal and crossbar and is rotative relative to the bottom section. An attachment to the pedestal includes a finger support bar specifically for fingernail polishing.

The device supports the customer's hands in the various positions required by the manicurist, it inhibits movement of the hand to thereby assist the manicurist, and flexing of the wrist and hand muscles are accommodated with minimum interference to the manicuring treatment.

The structure and its benefits will be more clearly understood by reference to the following detailed description having reference to the drawings wherein.

Figure 4:
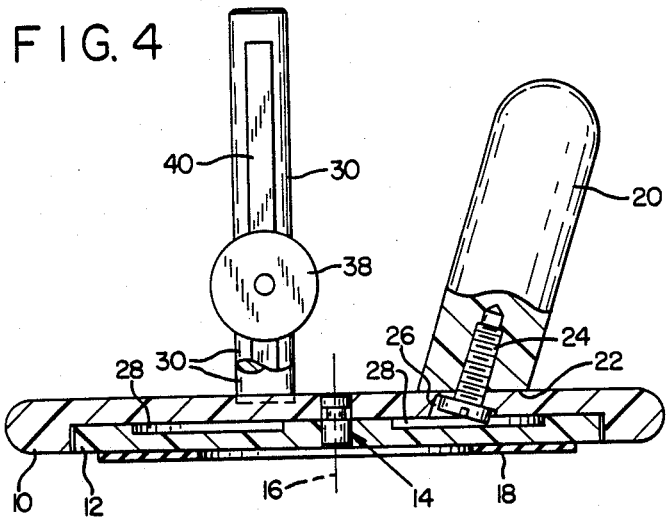
FIG. 4 is a sectional side view of the device of FIG. 1 illustrating the assembly of the device's various components.

Reference is first made to FIG. 4. The base of the device has a top plate 10 rotatably supported on a disk 12. The rotatable plate 10 is rotatably mounted to the disk 12 by spindle 14. Structural components for rotatably mounting a plate on a base such as disk 12 are well known and need not be further described. In general, the present structure includes a center pin that provide the axis of relative rotation of the disk and plate, i.e. about axis 16 of the spindle 14. Affixed to the bottom of the disk 12, as with an adhesive, is an elastomeric ring-shaped pad 18. The elastomeric pad 18 has a flat bottom surface that engages and grips a table top and prevents sliding of the device on the table top.

Projected upwardly from the plate 10 is a pedestal 20 which is angled outwardly from the axis 16 at about a 15 degree angle. This angle is provided by the angled bottom surface 22 of the pedestal resting flush on the flat top surface of plate 10. The pedestal is securely fixed to the plate 10 by a screw 24 projected up from the bottom and through the plate 10 and into the center of the pedestal. The screw head is inset in part as noted at 26 and the corresponding area of the disk 12 is inset as noted at 28 to avoid interference with the relative rotation of the disk 12 and plate 10.

Figure 5:
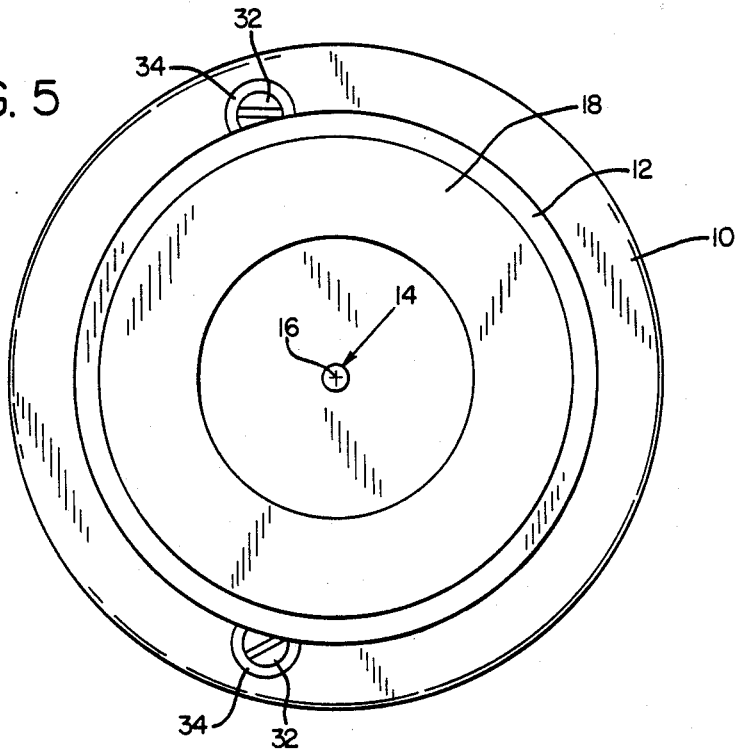
FIG. 5 is bottom view of the device of FIG. 1.

Also attached to the plate 10 are a pair of spaced apart posts 30. Attachment of these posts are provided by screws 32 projected up through the bottom of the plate 10 as seen in FIG. 5. The heads of screws 32 are also inset as indicated at 34.

A crossbar 36 is slidably mounted on the posts 30. Lock screws 38 project into the ends of the crossbar and screw up against an outwardly directed flat area 40 on each post 30. By loosening the lock screws 38, the crossbar can be adjusted to the desired elevation on the posts 30.

Figure 3:
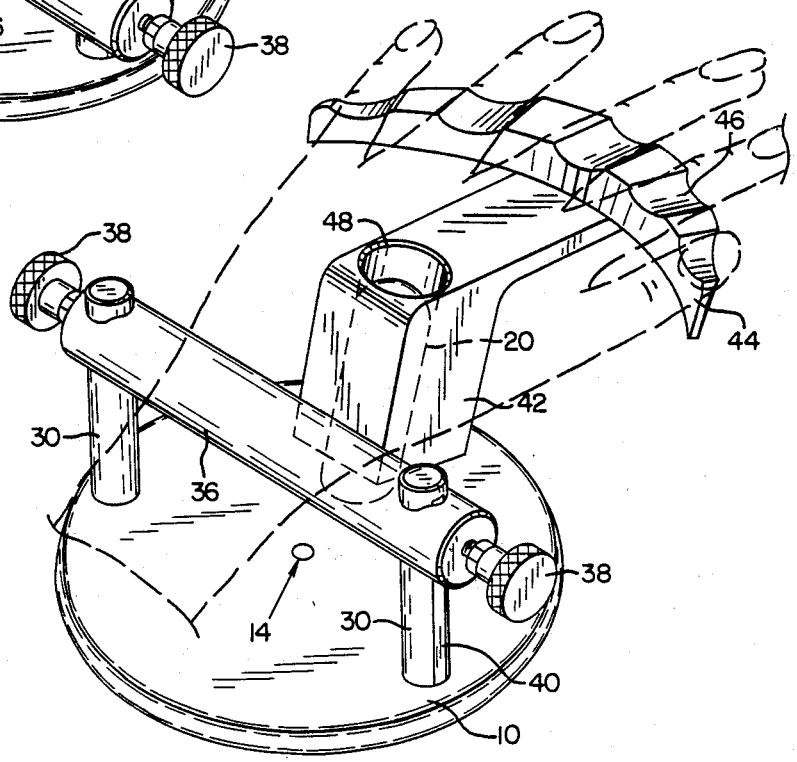
FIG. 3 is a perspective view of the device of FIG. 1 including an attachment for use in positioning a customer's fingers for fingernail polishing.

Reference is now made to FIG. 3 which illustrates a finger support adapter 42. The adapter 42 has a center hole 48 that is configured to permit the adapter to be slidingly mounted onto the pedestal 20. A finger support bar 44 carried by the adapter 42 provides notches 46 that position the customer's fingers as desired for polishing the fingernails thereof. The angle of the pedestal 20 enhances alignment of the adapter 42. That is, with the angled mounting the adapter does not readily rotate on the pedestal.

OPERATION

Figure 1:
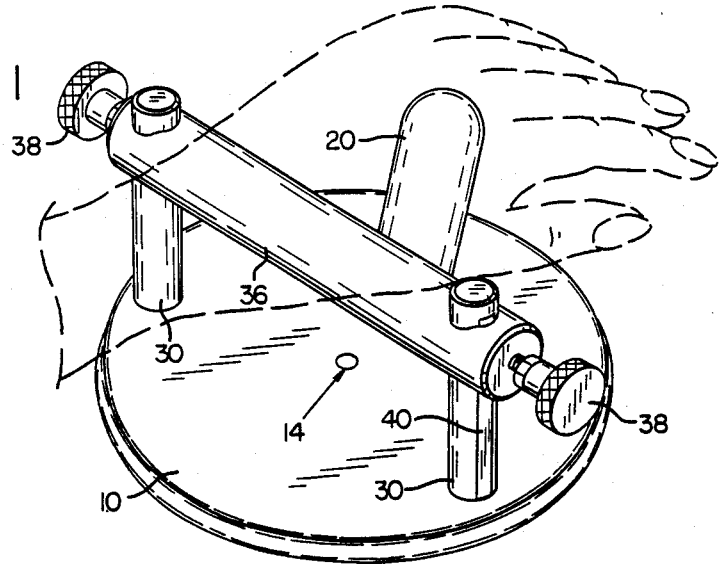
FIG. 1 is a perspective view of a device of the invention shown in use for manicuring the fingers of a customer.
Figure 2:
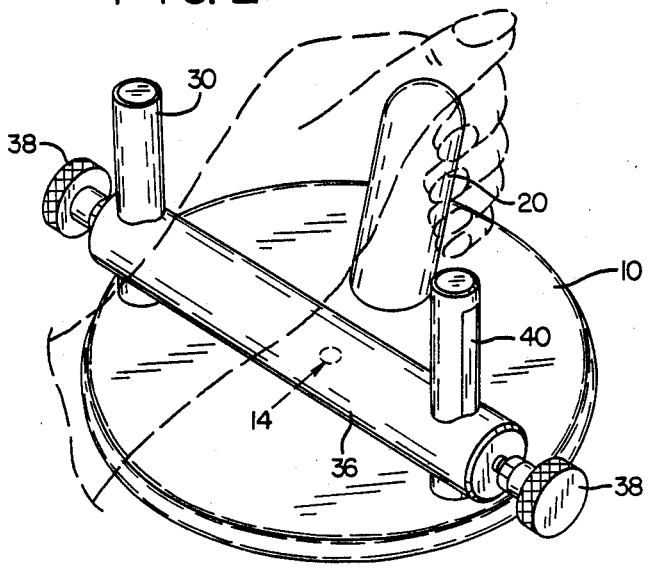
FIG. 2 is a perspective view of the device of FIG. 1 illustrating the use for manicuring the customer's thumb.

The use of the device is illustrated in FIGS. 1-3. FIG. 1 illustrates the primary function of the device. The device is portable, i.e. it can be lifted free of the table and placed on the table in a position that is most comfortable. Once in place, it will not move by reason of the gripping surface of the elastomeric ring 18. The line up of the bar and pedestal relative to the customer's position is also easily accommodated by the rotatability of the plate 10.

The crossbar 36 is generally elevated to a position near the top of the posts and with the screws 38 turned into the post 30, the customer simply lays his or her hand so that the bar contacts the wrist immediately behind the heel of the hand. The pedestal 20 is so located, i.e. between about 2 to 3-½ inches center-to-center from the crossbar 36, so as to allow the rounded top surface of the pedestal to centrally engage the palm of the hand.

The fingers thus hang loose and can be gripped, raised, turned, or whatever as needed to enable the manicurist to shape the fingernail. The crossbar 36 engaging the crease of the wrist tends to inhibit withdrawal of the hand and the manicurist does not have to hang on to the fingers as tightly. Yet, the customer is free, in a limited sense, to roll and flex the hand muscles without disturbing the manicurist. In any event, the position for the customer is much more natural.

FIG. 1 illustrates the hand position for manicuring the four fingers. The thumb is manicured as illustrated in FIG. 2. For the thumb, the crossbar is adjusted to its lowest position or even removed. The customer simply wraps his or her fingers around the pedestal and places the thumb over the top of the pedestal as illustrated.

FIG. 3 illustrates the device in use by a manicurist for painting the customer's fingernails. The L-shaped adapter 42 with finger bar 44 again enables the customer to comfortably rest his or her hand on the adapter in the pedestal area with the fingers projected onto the finger bar 44. The fingers are conveniently spaced by the notches and the hand is supported but in an elevated position, far more accessible than if laid on the table top.

Numerous modifications, additions, and adaptations will become apparent to those skilled in the art upon review of the disclosure herein. The angled pedestal is believed to be a desirable feature to provide more working space under the hand, e.g. as when the operator places her supporting or finger-gripping hand under and around the finger being worked on. However, the broad concept of the invention is not limited to this angled pedestal. Similarly the base is rotatable for adjustability convenience, but again the broader concept would encompass a non-rotating base.

These and other variations are encompassed by some or all of the claims appended hereto.

We claim:

1. A device for holding the wrist and palm of a customer's hand and thereby aiding manicurists comprising;

a base having a bottom surface adapted to rest on a table top, said bottom surface provided with a table-gripping surface that resists sliding movement of the device on the table top, a round wrist supporting crossbar, a pair of spaced apart posts attached to said base and supporting said crossbar in an adjustable elevated position above the base, and a palm supporting pedestal having an upper palm supporting surface supported above the base, said upper palm supporting surface spaced laterally from the length of the crossbar and centrally of the posts and spanning the distance between the wrist and center of the palm of a hand, and said crossbar and support surface being generally at the same heighth whereby the palm of a customer's hand will engage the palm supporting surface while the wrist of that same hand is supported on the crossbar to be thereby held in place and in position as desired by the manicurist;

the palm supporting pedestal having a rounded top surface forming the palm supporting surface, said palm supporting pedestal configured to provide a hand gripping shaft and having the additional function to be gripped by the customer's hand in a manner that positions the thumb of the hand on the palm supporting surface for manicure treatment.

2. A device as defined in claim 1 wherein the pedestal is additionally configured to receive an adapter, and including an adapter having a center opening to slide over the palm supporting pedestal for mounting of the adapter to the base, a finger supporting bar carried by the adapter and including notches for positioning the fingers of a hand for nail polishing.

3. A device as defined in claim 2 wherein the supporting pedestal is angled outwardly and upwardly relative to the crossbar for convenient mounting of the adapter and for user comfort.

4. A device as defined in claim 1 wherein the base includes an upper plate on which the support bar and pedestal are attached and a lower support disk having an elastromeric gripping surface for gripping the surface of a table top, and rotatable means for rotatably attaching the plate and disk to permit rotatable alignment of the disk while resisting sliding thereof on the table top surface.

* * * * *